US006375234B1

(12) United States Patent
Brackmann et al.

(10) Patent No.: US 6,375,234 B1
(45) Date of Patent: Apr. 23, 2002

(54) MOTOR-VEHICLE DOOR LATCH WITH SEALED HOUSING

(75) Inventors: Horst Brackmann, Velbert; Frank Kleefeldt, Heiligenhaus; Volker Westerwick, Bochum, all of (DE)

(73) Assignee: Kiekert AG, Heiligenhaus (DE)

( * ) Notice: Subject to any disclaimer, the term of this patent is extended or adjusted under 35 U.S.C. 154(b) by 0 days.

(21) Appl. No.: 09/559,929

(22) Filed: Apr. 27, 2000

(30) Foreign Application Priority Data

May 4, 1999 (DE) ..... 199 20 278

(51) Int. Cl.[7] ..... E05C 3/06

(52) U.S. Cl. ..... 292/1; 292/DIG. 23; 74/502.4; 74/502.6

(58) Field of Search ..... 292/216, 701, 292/DIG. 23; 74/502.4, 502.6, 500.5, 501.5 R

(56) References Cited

U.S. PATENT DOCUMENTS 4,735,447 A 4/1988 Kleefeldt
4,898,414 A * 2/1990 Yamada
5,678,869 A * 10/1997 Yoshikuwa
5,746,076 A * 5/1998 Inoue
5,752,346 A 5/1998 Kritzler
5,855,130 A * 1/1999 Rorabacher
6,050,117 A * 4/2000 Weyerstall

FOREIGN PATENT DOCUMENTS

DE 197 14 069 10/1998

* cited by examiner

*Primary Examiner*—Flemming Saether
(74) *Attorney, Agent, or Firm*—Herbert Dubno; Andrew Wilford

(57) ABSTRACT

A latch is mounted between the inside and outside of a motor-vehicle door provided with a plurality of actuating elements and respective links extending from the elements and each having a respective movable part. The latch has latching and locking mechanism, a closed housing enclosing the mechanism and formed with a respective openings receiving free ends of the links, and seals in the openings engaged hermetically around the link free ends. The free ends are connected inside the housing to the mechanism. The housing includes a pair of housing parts that are hermetically joined to each other and the mechanism includes locking and latching elements received in the respective parts. The holes are all formed in one of the parts.

6 Claims, 2 Drawing Sheets

MOTOR-VEHICLE DOOR LATCH WITH SEALED HOUSING

FIELD OF THE INVENTION

The present invention relates to a motor-vehicle door latch. More particularly this invention concerns such a latch that is connected to locking and latching elements of a motor-vehicle door.

BACKGROUND OF THE INVENTION

A standard motor-vehicle door has inside and outside panels carrying outside and inside handles serving for unlatching the door and outside and inside locking elements for locking and unlocking the door. The inside locking element is typically a button or lever and the outside locking element is normally only provided on the front doors and comprises a lock cylinder and/or a keypad. A motor-vehicle latch in the door holds latching and locking mechanism operated by the handles and actuators and normally engageable about a bolt mounted on the door post to secure the door shut. More specifically this mechanism normally includes actuating levers connected to the inside and outside handles, a release lever operated by the inside and, if provided, outside locking elements, and a retaining member or fork that fits around the bolt in a latched position.

As described in U.S. Pat. No. 4,735,447 the latch has an outer housing part formed with a recess in which the bolt is receivable and provided with a latch fork pivotal between a holding position securing the bolt in the recess and a freeing position permitting the bolt to enter and exit the recess and with a latch pawl pivotal on the outer housing part into and out of a position retaining the fork in the holding position. A middle housing part lying on the outer housing part carries releasing mechanism connected to the pawl for moving same into and out of its position retaining the fork in the locked position, locking mechanism connected to the releasing mechanism for preventing same from operating the pawl to release the fork, and locking and opening levers respectively connected to the locking and releasing mechanisms and connectable respectively to the outside door locking element and outside door handle for operating the respective mechanisms. An inner housing part lying on the middle housing part carries respective locking and opening links connected to the inside latching and locking elements and a servomotor connected to the locking mechanism for operating same and preventing operation of the releasing mechanism by the opening link and lever. Fasteners secure the parts to contain the mechanisms and servomotor.

In such a system the various levers project from the respective housing parts through relatively large openings that permit them to make the necessary movements. Even the connection to the bowden cable that normally extends to the inside latching element is a relatively large hole.

Thus a significant problem with this type of latch is that dust and water can get into the latch mechanism relatively easily. This obviously leads to premature wear and failure of the latch. In addition the relatively large openings through which the actuating levers and connecting links of the latch mechanism pass make it possible to break into the vehicle by gaining access to this mechanism through these holes in the latch housing.

In another system described in U.S. Pat. No. 5,752,346 a motor-vehicle door has generally upright inside and outside panels, a window frame above the panels, a track extending vertically between the panels into the frame, and a window glass vertically displaceable in the track between the panels.

A latch assembly has a holder, an outside door handle in the holder, a door latch on an edge of the door between the panels, and a connecting housing between the panels and having an upper part fixed to the door latch and a U-section lower part fixed to and carrying the holder for the outside handle with the handle on the outside door panel. A link rod extends between the outside door handle and the door latch and is laterally enclosed by the U-section lower part.

Such an arrangement offers considerable security and protection from the elements. It is however quite complex and expensive to manufacture.

OBJECTS OF THE INVENTION

It is therefore an object of the present invention to provide an improved motor-vehicle door latch.

Another object is the provision of such an improved motor-vehicle door latch which overcomes the above-given disadvantages, that is which is better protected against the elements, whose mechanism is better protected against inappropriate actuation, and which is of simple and inexpensive construction.

SUMMARY OF THE INVENTION

A latch according to the invention is mounted between the inside and outside of a motor-vehicle door provided with a plurality of actuating elements and respective links extending from the elements and each having a respective movable part. The latch has latching and locking mechanism, a closed housing enclosing the mechanism and formed with respective openings receiving free ends of the links, and seals in the openings engaged hermetically around the link free ends. The free ends are connected inside the housing to the mechanism.

In this manner the mechanism, at least the locking and actuating parts if not the actual latching element, that is the fork and its pawl, are completely protected inside the housing. The lack of gaps around the links prevents water or dust from outside from getting into the housing and also makes unwanted manipulation of the latch through these openings impossible.

According to the invention the housing includes a pair of housing parts that are hermetically joined to each other and the mechanism includes locking and latching elements received in the respective parts. The holes are all formed in one of the parts.

At least one of the links is a bowden cable that includes a flexible cable sheath engaged in the respective opening and engaged by the respective seal and a core longitudinally displaceable in the sheath and connected to the mechanism. In this case the seal engaging the sheath is an O-ring. The sheath can also be encapsulated or integrated right into the one housing part. Thus when assembling the door all that is necessary is to connect the outer free ends of the links to the various parts, such as the door handles, lock button, and/or lock cylinder, as the latch is delivered to the factory with the links already attached and integrated with the housing.

In accordance with the invention at least one of the links is rotatable and the respective free end includes a body rotatable in the housing and engaged by the respective seal. The body is rotatable about a respective axis and has radially outwardly projecting teeth. The mechanism includes a lever having a toothed end meshing with the teeth. More particularly, the body is a sleeve formed with a central throughgoing bore and the respective link has a head complementarily engageable in the bore. The housing is formed with a throughgoing passage in which the body is fitted and rotatable about its axis. This passage has an inner surface in which is set an O-ring constituting the respective seal.

BRIEF DESCRIPTION OF THE DRAWING

The above and other objects, features, and advantages will become more readily apparent from the following description, reference being made to the accompanying drawing in which.

SPECIFIC DESCRIPTION

Figure 2:
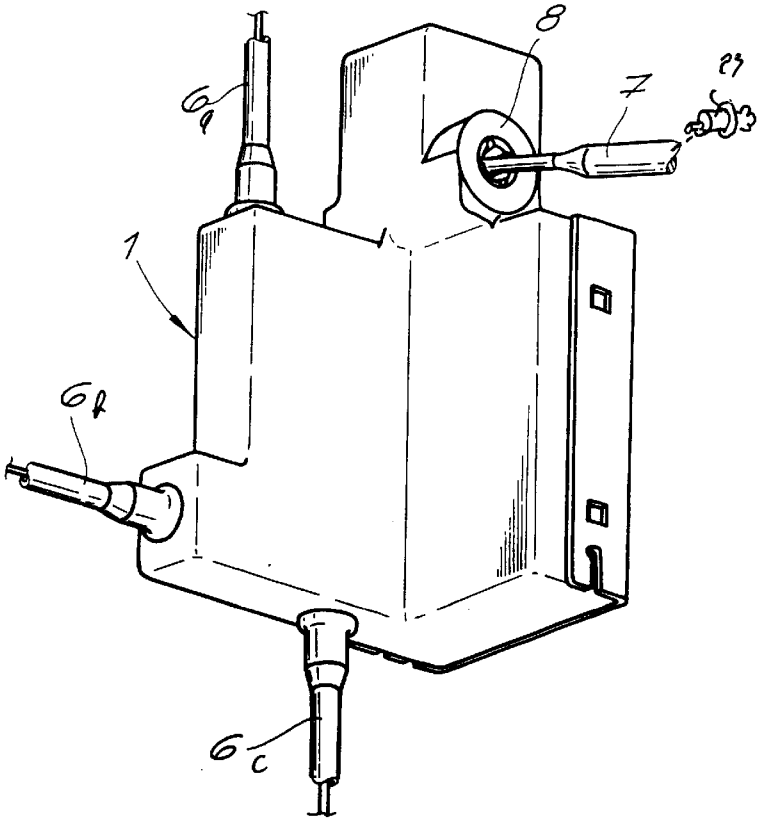
FIGS. 1 and 2 are perspective views taken in different directions of the latch according to the invention.
Figure 1:
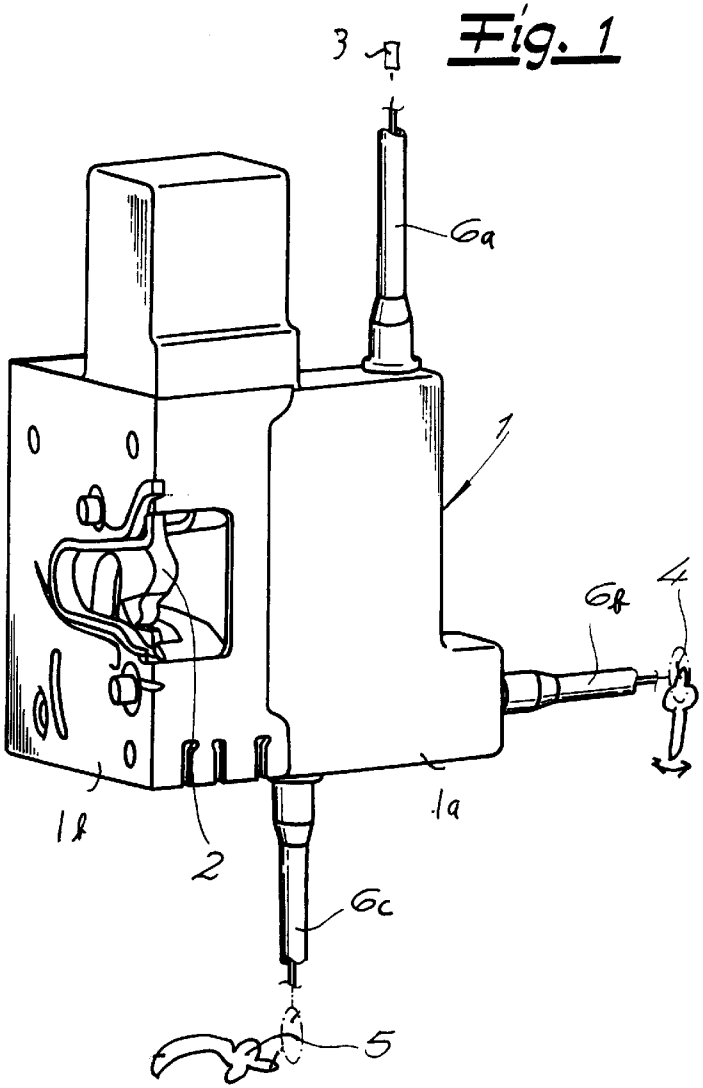

As seen in FIGS. 1 and 2 a motor-vehicle door latch 1 has a housing formed of two plastic parts 1*a* and 1*b* respectively holding the locking and latching mechanisms described in above-cited U.S. Pat. No. 4,735,447. The housing parts 1*a* and 1*b* are clipped, screwed, glued, or welded together so that no liquid or small particles can get into or between them. The locking and latching mechanism includes a standard lock fork 2 engageable around an unillustrated bolt projecting from a door post and various actuating and latching levers such as shown at 2' in FIG. 3 and 17 in FIG. 5. Normally the lock fork 2, its pawl, and the parts specifically aimed at the latching function are held in the housing part 1*b* while the various actuating and locking levers of the mechanism are held in the housing part 1*a*.

Figure 3:
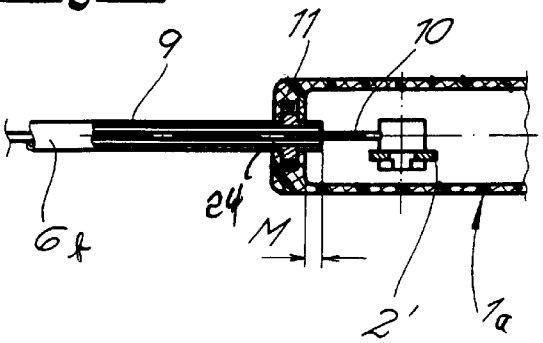
FIG. 3 is a section through one of the connections to the latch mechanism.
Figure 4:
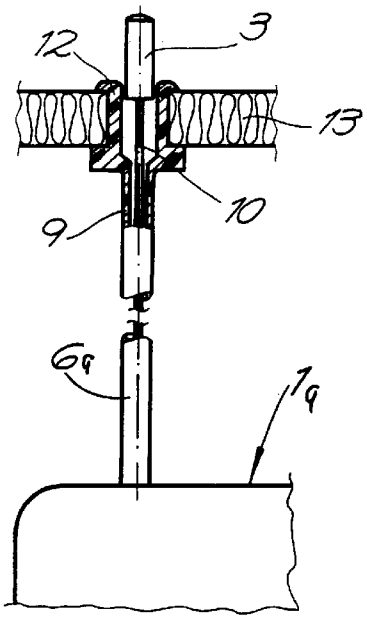
FIG. 4 is a sectional view illustrating an inside locking element.

The mechanism is operated from an inside locking button 3 via a bowden cable 6*a*, from an inside handle 4 via a bowden cable 6*b*, from an outside handle 5 via a bowden cable 6*c*, and from an outside locking device 23 or the handle 5 via a rotary link 7. Each of the bowdens 6*a* through 6*c* has as shown in FIGS. 3 and 4 a flexible but longitudinally inextensible and incompressible sheath 9 and a flexible but similarly inextensible and incompressible core 10. As shown in FIG. 3 the cables 6*a*, 6*b*, and 6*c* enter the housing part 1*a* at a snug hole 24 provided with a seal ring 11, the core 10 being connected as is standard to a pin on the respective mechanism lever 2'. The sheath 9 projects into the housing part 1*a* by an extent M for best sealing. Thus the point of entry of each such cable is sealed. The other end of the cable 6*a* for the door button 3, for instance, has the sheath 9 formed with a fitting 12 set in the upper wall 13 of the door, with the core 10 connected directly to the button 3. In fact the sheaths 9 can be permanently affixed to the housing part 1*a* so that the latch 1 is delivered to the installer with the cables 6*a*, 6*b*, and 6*c* already attached and ready to be connected up at their outer ends.

Figure 5:
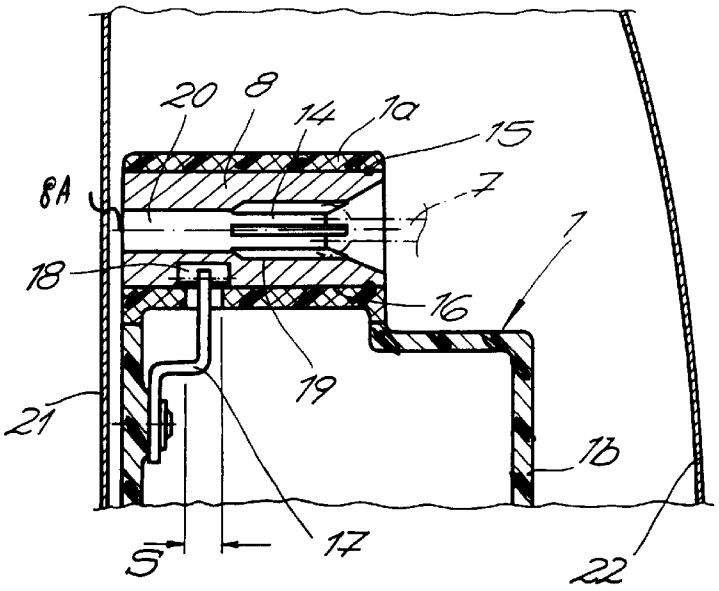
FIG. 5 is a section through a detail of the latch.

FIG. 5 shows how the rotary link 7 is received in a cylindrical sleeve 8 rotatable about its axis 8A in a throughgoing cylindrical guide hole 16 formed in the housing part 1*a*. Such a structure is described in German patent document 197 14 069 and U.S. patent application Ser. No. 09/221,252 filed Dec. 8, 1998 (now U.S. Pat. No. 6,067,869). A seal ring 16 is provided around one end of the passage 16 to reduce entry of moisture. The sleeve 8 has a throughgoing bore 20 formed at one end with alternating ridges 14 and grooves 19 to fit with complementary formations on a ball at the end of the link 7 so as to rotationally couple the two parts 7 and 8 together. The locking lever 17 has a gear-sector end fitting with teeth 18 formed in a radially outwardly open notch cut in the sleeve 8. These teeth 18 have an axial length S that is fairly long so that even if the sleeve 8 shifts somewhat, the teeth 18 and lever 17 will remain in mesh. Thus rotation of the link 7 will turn the sleeve 8 and pivot the lever 17. Leakage into the latch 1 is impossible, and any liquid that gets into the hole 20 will be able to run out its open end. FIG. 5 shows the inside and outside door panels 21 and 22.

Instead of an axially throughgoing hole 20 for drainage, there could be a radially throughgoing hole in the sleeve 8 with a matching hole in the outer wall of the housing part 1*a* to prevent water from getting trapped in the part 8.

We claim:

1. In a motor-vehicle door provided with a plurality of actuating elements and respective links extending from the elements and each having a respective movable part, a latch comprising:

mechanism including a lever having a toothed end;

a closed housing enclosing the mechanism and formed with respective openings receiving free ends of the links and with a throughgoing passage, one of the links being rotatable and the respective free end including a sleeve rotatable in the passage about a respective axis, forming the respective movable part, formed with a central throughgoing bore, and having radially projecting teeth meshing with the toothed end, the respective link of the sleeve having a head complementarily engageable in the bore; and seals in the openings engaged hermetically around the link free ends and sleeve, the free ends being connected inside the housing to the mechanism.

2. The motor-vehicle door latch defined in claim 1 wherein the housing includes a pair of housing parts that are hermetically joined to each other and the mechanism includes locking and latching elements received in the respective parts.

3. The motor-vehicle door latch defined in claim 1 wherein the holes are all formed in one of the parts.

4. The motor-vehicle door latch defined in claim 1 wherein at least one of the links includes a flexible cable sheath engaged in the respective opening and engaged by the respective seal; and a core longitudinally displaceable in the sheath, forming the movable part, and connected to the mechanism.

5. The motor-vehicle door latch defined in claim 4 wherein the seal engaging the sheath is an O-ring.

6. The motor-vehicle door latch defined in claim 1 wherein the passage has an inner surface in which is set an O-ring constituting the respective seal.

* * * * *